United States Patent [19]

Carney

[11] Patent Number: 4,918,880

[45] Date of Patent: Apr. 24, 1990

[54] DECK SEAT AND SAFETY RAIL COMBINATION

[76] Inventor: Wayne R. Carney, R.D. 2 Box 177, Stockton, N.J. 08889

[21] Appl. No.: 295,827

[22] Filed: Jan. 11, 1989

[51] Int. Cl.[5] ..... A47C 11/00

[52] U.S. Cl. ..... 52/8; 52/79.6; 297/217; 297/232; 297/451

[58] Field of Search ..... 52/8, 9, 6, 7, 79.6, 52/188, 36; 297/15, 217, 232, 243, 440, 451, 463; 182/82, 132

[56] References Cited

U.S. PATENT DOCUMENTS

| | | | |
|---|---|---|---|
| 980,532 | 1/1911 | Johnson | 182/82 |
| 2,171,374 | 8/1939 | Ryan et al. | 52/8 X |
| 2,817,389 | 12/1957 | Richards | 52/8 |
| 2,987,111 | 6/1961 | Walworth | 52/9 |
| 3,352,069 | 11/1967 | Curra, Jr. | 52/9 |
| 4,237,661 | 12/1980 | Adams, Sr. et al. | 52/8 |
| 4,285,542 | 8/1981 | Boisvert | 297/217 |
| 4,438,603 | 3/1984 | Durkan, Jr. | 52/8 |

*Primary Examiner*—Richard E. Chilcot, Jr.

[57] ABSTRACT

In combination with a horizontal deck arrangement supported above ground level and having a facia member attached to and extending below the deck along at least a portion of the periphery thereof, a seat and safety rail assembly comprises a plurality of brackets spaced along and attached in upstanding relationship to the facia member. Each bracket comprises an extended, generally vertical lower post member, a seat support member substantially perpendicular to the post member, having a front extremity joined to the post member and a back extremity; a back support member joined to the back extremity of the seat support member and extending away from the seat support member in a direction generally opposite the post member; a top rail support member joined to the back support member remote from the seat support member and having at least a portion thereof extending from the back support member outwardly from the facia member; a brace extending between the seat support member and the extended post member for maintaining the two last-named members in substantially fixed relationship; and means adjacent the end of the extended post member remote from the seat support member for fastening the assembly to the facia member in a cantilevered fashion.

15 Claims, 2 Drawing Sheets

DECK SEAT AND SAFETY RAIL COMBINATION

BACKGROUND OF THE INVENTION

This invention relates to perimeter seat and safety rail arrangements for a deck or the like and more particularly to an improved, easily assembled space-saving and cost-saving configuration of the foregoing type.

In particular, this invention relates to a unitary bracket assembly for support of both a safety railing and a seat arrangement extending in a cantilevered fashion beyond the edge of a deck or the like.

In the construction of a deck or porch adjacent to a building such as a dwelling place or the like, it is usually desirable and often required by building codes that a safety railing of an appropriate height (e.g. thirty to forty inches) be provided along the open periphery of the deck. Furthermore, seating facilities generally are desirable on the deck and a cost and space-efficient manner for providing such seating is to combine the seat (or bench) with at least a portion of the railing. It is most often the case, however, that in such a combined rail-seat arrangement, the seat projects inwardly from the edge of the deck so that a portion of the deck area is covered by the seat. The loss of that deck space is undesirable and represents an added cost per square foot of usable deck space.

In general, structural and safety requirements have dictated against cantilevered seat and railing arrangements in connection with decks.

Furthermore, in order to provide sufficient strength and rigidity in a railing, it is necessary to utilize lumber of such proportions that the ultimate structure would be both expensive and unsightly.

It is therefore an object of the present invention to provide a combination seat and safety rail for a deck assembly which does not intrude on the deck area itself.

It is a further object of the present invention to provide a combination seat and safety rail for a deck assembly in which a simple and lightweight but rigid structure is provided which permits a cantilevered arrangement of the seat and rail.

STATEMENT OF THE INVENTION

In accordance with the present invention, where a horizontal deck arrangement is supported above ground level and has a facia member attached to and extending below the decking along the periphery thereof, a seat and safety rail assembly comprises a plurality of brackets spaced along at least a portion of the periphery of the deck. The brackets are attached in generally vertical (upstanding) relationship to the facia member and each bracket comprises an extended, generally vertical lower post member and a seat support member substantially perpendicular to the post member. The seat support member has a front extremity jointed to the post member and a back extremity, the seat support member extending from the post member away from and lying substantially entirely outside the facia member. A back support member is joined to the back extremity of the seat support member and extends away from the seat support member in a direction generally opposite the post member. A top rail member is joined to the back support member remote from the seat support member and has at least a portion thereof extending from the back support member outwardly relative to the facia member. A brace extends between the seat support member and the extended post member for maintaining the two last-named members in substantially fixed relationship. Means are provided adjacent the end of the extended post member remote from the seat support member for fastening the assembly to the facia member.

THE DRAWING

Further objects and advantages of the invention will be described and will become apparent from the following description taken in conjunction with the accompanying drawing, in which.

DETAILED DESCRIPTION

Figure 1:
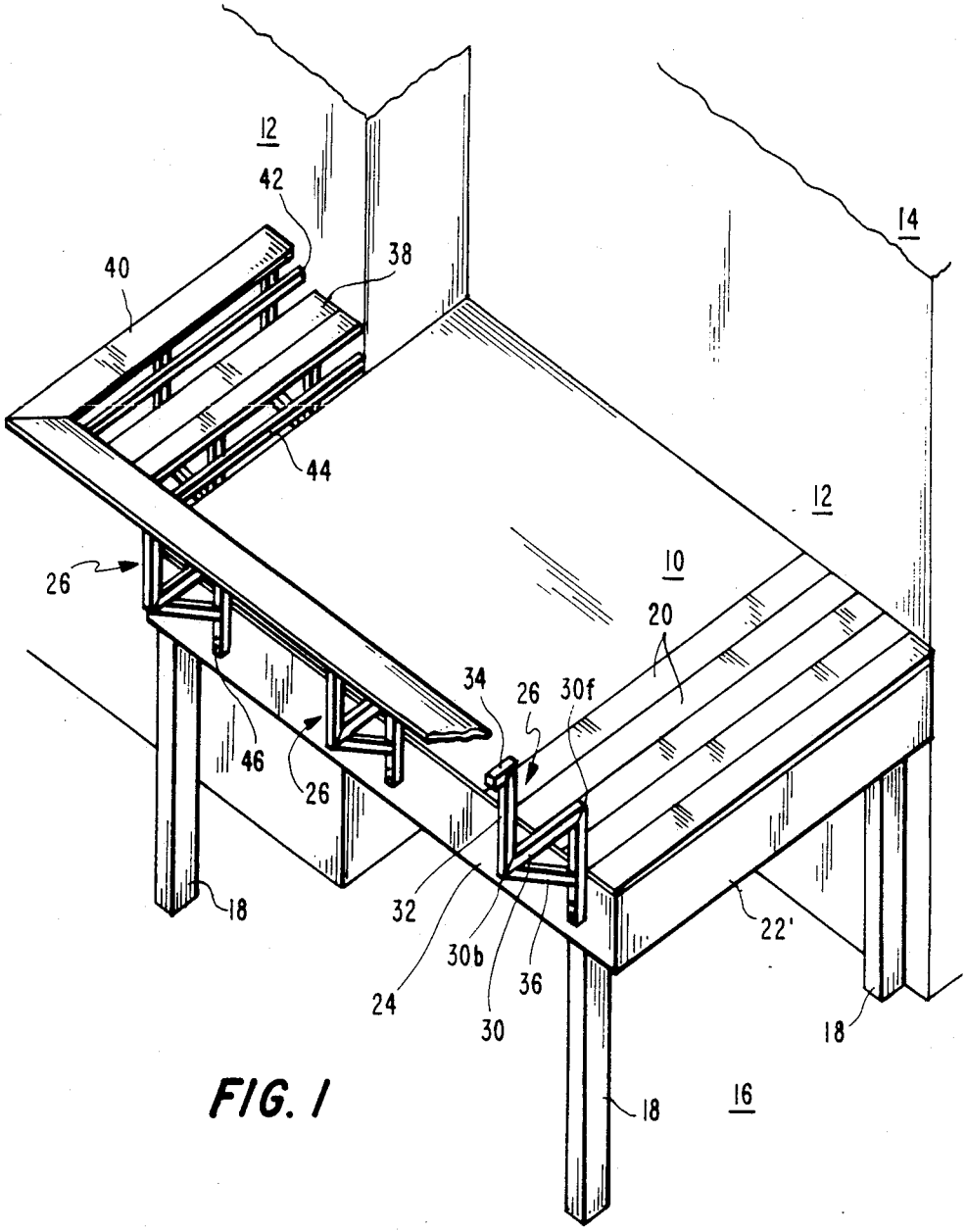
FIG. 1 is a partial perspective view of a deck and an associated safety rail-seat arrangement constructed in accordance with the present invention.

Referring to the drawing and, in particular to FIG. 1, a horizontal deck 10 extending outwardly from one or more walls 12 of a structure 14 such as a dwelling place is shown supported above ground level 16 by a plurality of columns 18. The deck 10 may, in fact, be elevated as shown or may be at or near ground level. As is customary, the deck 10 is comprised of individual decking boards 20 such as 2"×4" or 2"×6" pressure treated lumber laid with their width dimension (4" or 6") serving as the surface of the deck 10. The boards 20 are supported by means of joists 22 extending from the wall 12 outwardly to a beam 24 of substantially the same dimensional size lumber (e.g. 2"×6" or larger) as the joists 22. Beam 24 may be made up to two or more individual members (a "double") as may be required according to the span between columns 18 on which beam 24 is supported. The outermost portion of beam 24 and the extreme ones of the joists 22 nearest the edge of deck boards 20 form facia members 24', 22' which are at or near the periphery of the deck 10 and extend downwardly below the decking.

A combined seat and safety rail assembly, including a plurality of unitary brackets indicated generally by the reference numeral 26, is provided along at least a portion of the periphery of deck 10. The brackets 26 are regularly spaced along the periphery of deck 10 separated, for example, by a dimension in the range of two to four feet according to structural and/or code requirements. Each of the brackets 26 is formed, for example, of either a U-shaped channel or a closed box of relatively rigid and durable material such as steel or aluminum of approximately ten gauge thickness. The brackets 26 are formed of metal so that their cross-section produces a minimal visual obstruction while providing the required relatively high strength. The brackets are arranged to present a pleasing appearance in combination with associated structural elements made of wood.

Figure 3:
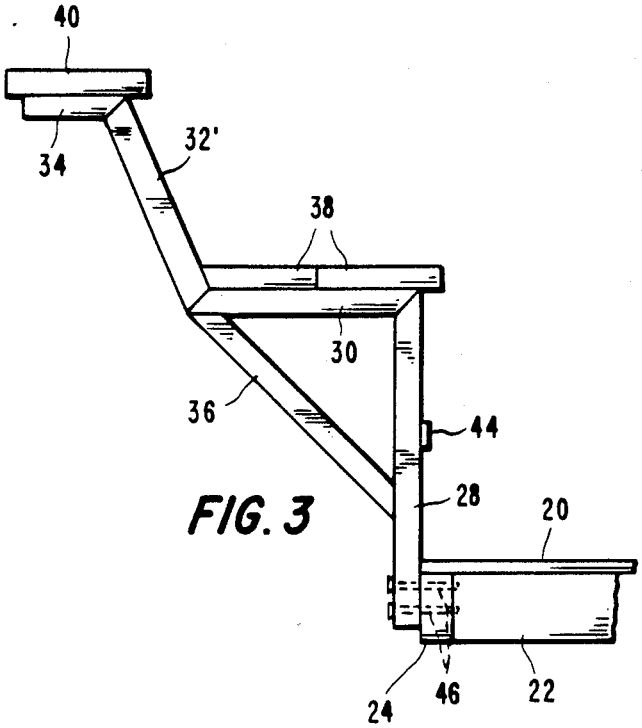
FIG. 3 is an enlarged detailed view of a second embodiment of the bracket assembly of FIG. 1.

Each of the brackets 26 comprises an extended, generally vertical lower post member 28, and a seat support member 30 substantially perpendicular to the post member 28 having a front extremity **30*f* joined to the post member 28 and a back extremity 30*b* which is joined to a back support member 32. The back support member 32 extends away from seat support member 30 in a direction generally opposite the lower post member 28. For example, back support member 32 may be vertical or may be inclined outwardly (see FIG. 3**) at a slight angle away from vertical or, if desired, may include a desired curvature and/or compound angular arrangement for appearance and comfort in seating.

A top rail support member 34 is joined to an uppermost end of back support member 32 remote from the seat support member 30. Top rail support member 34 has a portion extending in a direction outwardly with respect to the facia member 24' or 22' of deck 10 and, if desirable, may also include an inwardly extending portion, each of which lie substantially in a horizontal plane when the assembly is erected on a deck 10.

An inclined brace 36 at an angle, for example, of 45°, is provided between the underside of seat support member 30 and the outer portion of lower post member 28 to maintain the two members 28 and 30 in substantially fixed relationship when a load is placed upon seat support member 30.

The combination of lower post member 28 and seat support member 30, as well the combination of back support member 32 and top rail support member 34, each may be fabricated from a single piece of channel shaped or box-shaped material by appropriately cutting either rectangular or triangular pieces out of the side rails of the material at the desired junctions between each of members 28 and 30 or 32 and 34 and then bending the remaining face of the material at the desired junction point. The joined members are then welded or otherwise rigidly fastened together at their junctions to form the overall bracket 26 into a unitary, rigid structure. Alternatively, each of the members 28, 30, 32 and 34 may be formed separately and thereafter be joined, for example by welding, to form the desired rigid unitary bracket structures.

Preferably, the brackets 26 are fabricated away from the construction site and are prefinished in the fabrication facility by, for example, appropriate surface preparation and spray painting in colors such as bronze, white or otherwise similarly to storm windows.

The lowermost extremity of the lower post member 28 is fastened to a facia member (beam 24' or joist 22') of deck 10, for example, by means of bolts 36, or other similar fastening devices to provide a rigid connection to the facia member and deck 10. In the case where the boards of deck 10 extend beyond the facia member, suitable notches may be provided in such boards to facilitate mounting of brackets 26.

A seating platform consisting of individual boards 38 of an appropriate width and length span the space between the seat support members 30. The seat boards 38 may, for example, be 2"×4", 2"×6" or 2"×8" lumber, as desired. Similarly, top rail boards 40, spanning the spaces between rail support members 34, are fastened to rail support members 34 by, for example, bolts (not shown). Rail boards 40 may comprise 2"×4" or 2"×6" (or greater) lumber which is arranged with its width disposed in a horizontal plane so that objects may rest on rail boards 40. Rail boards 40 may be wider than rail support member 34 and may extend either inwardly or outwardly beyond the ends of rail support members 34.

The length of lower post member 28 is selected taking into account the desired length of the seat above deck 10, the thickness of the decking material 20 and the vertical height of joists 22. While the preferred height of a seat generally is of the order of eighteen inches, it is recognized that a range of sixteen to eighteen inches is suitable, according to individual preference. The bracket 26 therefore may be fabricated, for example, with a post member 28 twenty-three inches in length to take into account a 2"×6" joist (5½" height), 2"×4" decking (1½" height) and a seat height of 17½ inches above deck 10.

In that case, the back support member 32 has a total length of twenty inches in order to provide a rail board 40 having a top surface thirty-six inches above deck 10.

The foregoing dimensions are given as exemplary only and various combinations of dimensions readily may be utilized. However, in order to provide a desirable degree of versatility without an undue cost penalty, it is preferable that standard dimensions be adopted for the brackets 26 and necessary variations in the height of seat boards 38 or the height of rail boards 40 above deck 10 be achieved by appropriate mounting of the post portion 28 on facia member 22'. Furthermore, an extended post portion 28 may be made standard to accommodate deeper joists 22 and such post portions 28 may be cut off if unneeded upon installation.

Figure 2:
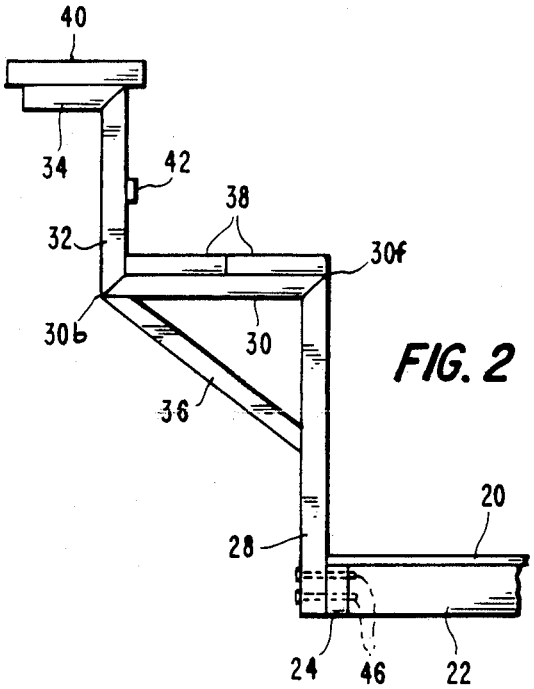
FIG. 2 is an enlarged detailed view of one embodiment of the bracket assembly of FIG. 1.

As is shown in FIG. 2, in order to provide added safety and security, an additional backrest member 42 is provided across adjacent back supports 32. In addition, one or more guard rail members 44 (FIG. 3) are provided partway up the lower posts 28 if desired or required by building codes. The cross-section of members 42 and 44 may be smaller than that of the brackets 28 (e.g of the order of ¾" square).

It should be noted that the portions of the various elements which meet at a miter at the corner of the deck 10 should be fastened together by unobtrusive strengthening members (not shown) such as commonly available flat angle members or metal plates or the like spanning the miter joint.

While the invention has been described in terms of one or more preferred embodiments of the invention, further modifications may occur to persons skilled in this art without departing from the scope of this invention as set forth in the following claims.

What is claimed is:

1. In combination with a horizontal deck arrangement supported above ground level and having a facia member attached to and extending below the deck along the periphery thereof, a seat and safety rail assembly comprising:

a plurality of brackets spaced along said periphery and attached in upstanding relationship to said facia member, each said bracket comprising:

an extended, generally vertical lower post member, a seat support member substantially perpendicular to said post member, having a front extremity joined to said post member and a back extremity, said seat support member extending from said post member away from and lying substantially entirely outside said facia member;

a back support member joined to said back extremity of said seat support member and extending away from said seat support member in a direction generally opposite said post member;

a top rail support member joined to said back support member remote from said seat support member and having at least a portion thereof extending from said back support member outwardly from said facia member;

a brace extending between said seat support member and said extended post member for maintaining said two last-named members in substantially fixed relationship; and means adjacent the end of said extended post member remote from said seat support member for fastening said assembly to said facia member.

2. A seat and safety rail assembly according to claim 1 wherein:

said lower post member and said seat support member are rigidly joined together in substantially perpendicular relationship.

3. A seat and safety rail assembly according to either claim 1 or claim 2 wherein:

said lower post member, said seat support member and said back support member are formed of a rigid material having at least three sides in the shape of a channel and at least said lower post and said seat support members are joined at adjacent portions of their respective three-sided channels.

4. A seat and safety rail assembly according to claim 3 wherein:

said back support member is formed of the same channel-shaped material as said post and seat support members and three sides of said back support channel are rigidly connected to corresponding sides of said seat support channel.

5. A seat and safety rail assembly according to claim 3 wherein:

said rail support member and said back support member are formed in a four sided enclosed box shape.

6. A seat and safety rail assembly according to claim 3 wherein said adjacent portions are joined by welding.

7. A seat and safety rail bracket assembly for use with a horizontal deck arrangement supported above ground level and having a facia member attached to and extending below the deck along at least a portion of the periphery thereof, the seat and safety rail bracket comprising:

an extended, generally vertical lower post member, having a lowermost extremity adapted for fastening to said facia member outside the periphery of said deck;

a seat support member substantially perpendicular to said post member, having a front extremity joined to said post member and a back extremity, said seat support member extending from said post member in a direction so as to cause said seat support member to lie substantially entirely outside said facia member;

a back support member joined to said back extremity of said seat support member and extending away from said seat support member in a direction generally opposite said post member;

a top rail support member joined to said back support member remote from said seat support member and having at least a portion thereof extending from said back support member in a direction to cause said rail support member to lie outwardly from said facia member; and a brace extending between said seat support member and said extended post member for maintaining said two last-named members in substantially fixed relationship.

8. A seat and safety rail bracket assembly according to claim 7 wherein:

said lower post member and said seat support member are rigidly joined together in substantially perpendicular relationship.

9. A seat and safety rail bracket assembly according to either claim 7 or claim 8 wherein:

said lower post member, said seat support member and said back support member are formed of a rigid material having at least three sides in the shape of a channel and at least said lower post and said seat support members are joined at adjacent portions of their respective three-sided channels.

10. A seat and safety rail bracket assembly according to claim 9 wherein:

said back support member is formed of the same channel-shaped material as said post and seat support members and three sides of said back support channel are rigidly connected to corresponding sides of said seat support channel.

11. A seat and safety rail bracket assembly according to claim 9 wherein:

said top rail support member and said back support member are formed in a four sided enclosed box shape.

12. A seat and safety rail assembly according to claim 1 and further comprising:

a plurality of substantially flat seat boards extending across said seat support members of adjacent ones of said brackets to form a continuous bench lying principally outside of said facia members of said deck.

13. A seat and safety rail assembly according to claim 12 wherein:

said seat boards are fastened to said seat support members to maintain said overall assembly in rigid relationship outside of said facia members.

14. A seat and safety rail assembly according to either claim 1 or claim 12 and further comprising:

at least one rail board extending across said top rail support members of adjacent ones of said brackets to form a continuous rail lying outside of said facia member of said deck.

15. A seat and safety rail assembly according to claim 13 wherein:

said rail board is fastened to said top rail support members to maintain said overall assembly in rigid relationship outside of said facia members.

* * * * *